US005175918A

United States Patent [19]

Christopher

[11] Patent Number: 5,175,918

[45] Date of Patent: Jan. 5, 1993

[54] PORTABLE CONTAINER WITH PIVOTABLE CLOSURE AND METHOD OF MANUFACTURE THEREOF

[76] Inventor: Gary Christopher, 5211 La Jolla Blvd., La Jolla, Calif. 92037

[21] Appl. No.: 714,708

[22] Filed: Jun. 13, 1991

Related U.S. Application Data

[63] Continuation-in-part of Ser. No. 472,733, Jan. 31, 1990, Pat. No. 5,035,344.

[51] Int. Cl.[5] ..... B23P 11/00

[52] U.S. Cl. ..... 29/434; 29/455.1; 220/336

[58] Field of Search ..... 29/434, 436, 453, 455.1; 220/336, 264

[56] References Cited

U.S. PATENT DOCUMENTS

| | | | |
|---|---|---|---|
| 530,796 | 12/1894 | Pratt | 220/264 |
| 3,731,837 | 5/1973 | Platts et al. | 220/336 X |
| 3,767,111 | 10/1973 | Pattengill | 220/336 X |
| 3,886,645 | 6/1975 | Schurman | 29/434 |
| 4,146,048 | 3/1979 | McCabe | 29/434 X |
| 4,155,127 | 5/1979 | Seiderman | 29/453 X |
| 4,351,630 | 9/1982 | Hayberg et al. | 29/453 X |
| 4,678,011 | 7/1987 | Weber | 220/336 X |
| 5,035,344 | 7/1991 | Christopher | 220/336 |

*Primary Examiner*—Timothy V. Eley
*Assistant Examiner*—R. Martin
*Attorney, Agent, or Firm*—Don J. Flickinger; Jordan M. Meschkow; Lowell W. Gresham

[57] ABSTRACT

A panel-like lid is secured to a receptacle by a pintle for pivotal movement between a closed position and an open position about an axis whereby the lid remains horizontal at all times. In the closed position, a continuous groove in the underside of the lid matingly receives a bead upstanding from the upper edge of the sidewall of the receptacle. A compression spring encircling the pintle normally urges the lid downwardly against the receptacle. In response to movement from the closed position toward the open position, the lid is cammed upwardly to disengage the groove from the bead.

6 Claims, 4 Drawing Sheets

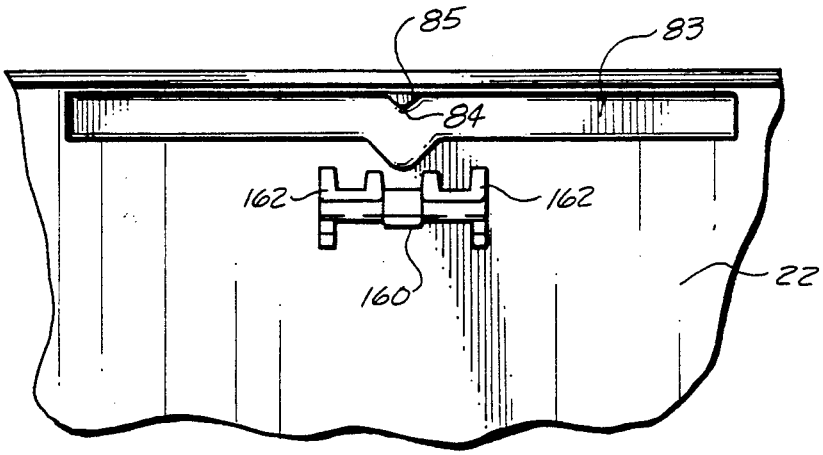
FIG. 12
FIG. 13
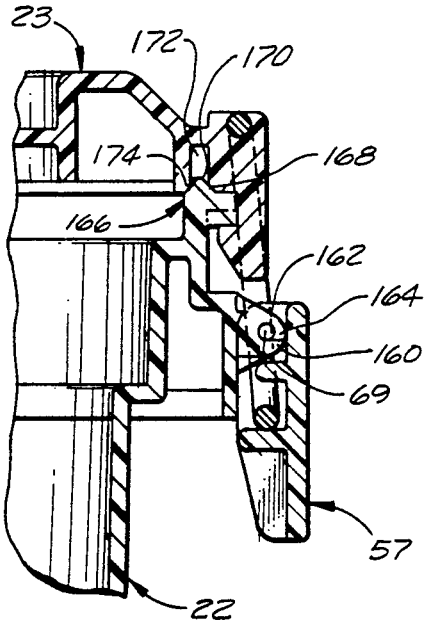
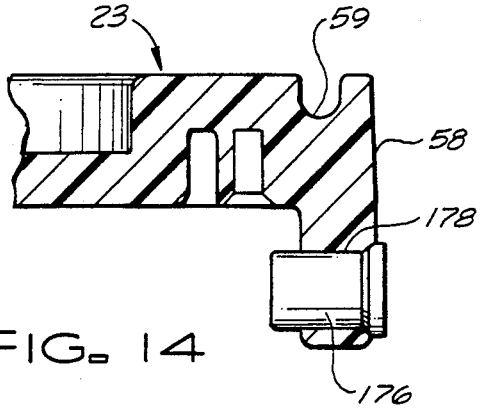
FIG. 14
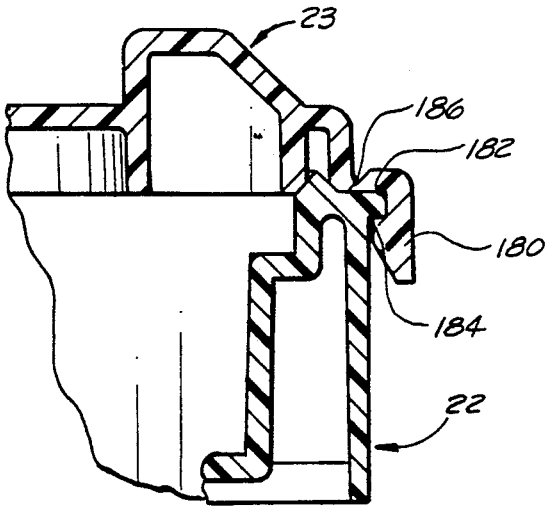
FIG. 15

PORTABLE CONTAINER WITH PIVOTABLE CLOSURE AND METHOD OF MANUFACTURE THEREOF

CROSS-REFERENCE TO RELATED APPLICATIONS

This application is a continuation-in-part of U.S. patent application Ser. No. 472,733, which was filed on Jan. 31, 1990 now U.S. Pat. No. 5,035,344.

BACKGROUND OF THE INVENTION

1. Field of the Invention

This invention relates to containers having pivotable closures.

More particularly, the present invention relates to portable containers of the type commonly used for storage and transportation of food and drink.

In a further and more specific aspect, the instant invention concerns a container including a closure having a lid which remains in a horizontal plane during movement between the closed position and the open position, and a method of manufacturing such a container.

2. Prior Art

Closures or lid assemblies of the type especially adapted for use in connection with portable containers are well known. A familiar application concerns devices particularly devised for storage and transporting of food and drink. Commonly referred to as ice chests or coolers, the devices are frequently employed for personal use such as associated with picnics, spectator events and travel.

The traditional ice chest or cooler includes an insulated container or receptacle for receiving food and drink. Ice, usually in form of cubes, are added either to maintain temperature or prevent spoilage. The access opening in the container, generally located at the top, is normally sealed with an openable lid. Customarily, the device is provided with one or more carrying handles or straps.

Various sorts of closure structures are commonly associated with commercially available devices of the type of immediate interest. Especially popular, particularly in combination with rectangular containers, in a generally flat, panel-like lid which is hingedly coupled along an edge to an upper edge of the receptacle. An oppositely located hasp structure holds the lid in the closed position.

Another popular closure structure includes a lid which extends upwardly inward from opposite edges to a centrally located handle. Ears, depending from opposite ends of the lid, are pivotally affixed to respective sides of the receptacle. Cylindrical coolers are generally fitted with removable lids which either frictionally or threadingly engage the receptacle.

Understandably, prior art closure structures adequately serve the primary function of closing the receptacle and inhibiting thermal loss. However, such apparatus have not proven to be entirely satisfactory. For example, prior art lids generally require substantial manual manipulation to open and to close. Frequently, both hands of the user must be employed simultaneously. Accordingly, any items which are to put into or retrieved from the cooler must be temporarily removed from the grasp of the user. In addition to the inconvenience, a temporary resting place is not always immediately available.

The flat, generally horizontal top of panel-like lids provides an inviting and readily usable surface upon which food items are frequently held during use or preparation. However, panel-like lids tilt during opening and closing. As a result, any items resting upon the lid must be removed each time access to the cooler is desired.

It would be highly advantageous, therefore, to remedy the foregoing and other deficiencies inherent in the prior art.

Accordingly, it is an object of the present invention to provide a container with an improved closure structure.

Another object of the invention is the provision of an improved closure structure of the type especially adapted for portable containers as exemplified by ice chests and coolers.

And another object of the invention is to provide a container with a closure structure that is especially easy and convenient to manipulate.

Yet another object of this invention is the provision of a container having a lid which presents a readily usable placement and holding surface.

Still another object of the invention is to provide a container having a lid upon which items may remain during opening and closing.

Still another object of the immediate invention is the provision of a container with a closure structure which can be handily operated by a single hand of a user.

And a further object of the invention is to provide a container having ameliorated sealing means between the lid and the receptacle.

Yet a further object of the immediate invention is the provision of a container and closure structure having means for inherently effecting a seal between the lid and the container.

Still a further object of the invention is to provide a closure structure which is adaptable for use on selected prior art receptacles and containers.

And yet a further object of the invention is to provide a relatively inexpensive method of manufacturing an exceedingly durable and maintenance-free container and closure structure of the foregoing character.

SUMMARY OF THE INVENTION

Briefly, to achieve the desired objects of the instant invention in accordance with a preferred embodiment thereof, first provided is a container including a receptacle, a lid and pivot means for affixing the lid to the receptacle for pivotal movement between a closed position and an open position. During movement, the plane of the lid remains horizontal. Next provided are seal means including an element of a male/female engagement pair extending continuously along the upper edge of the side wall of the receptacle and a complemental element of the male/female engagement pair carried by the lid. Biasing means normally retain the element in mating engagement with the complemental element when the lid is in the closed position. Also provided are cam means for disengaging the element from the complemental element as the lid is moved from the closed position toward the open position.

In accordance with a more specific embodiment of the invention, the pivot means includes a hinge block extending inwardly from the side wall of the container and a pintle extending through the lid and the hinge block. A compression spring urges the pintle downwardly to exert force upon the lid and thereby retain the lid in the closed position. One element of the seal means is in the form of a continuous bead. The other element of the seal means is in the form of a continuous groove for matingly receiving the bead. As the lid is pivoted about the pintle toward the open position, the bead cams against the groove to oppose the action of the spring and lift the lid from the upper edge of the receptacle. The invention may further include a hasp for holding the lid in the closed position.

The method according to the instant invention includes the steps of providing a receptacle, forming a lid from plastic, and pivotably securing the lid to the receptacle. In one embodiment of the invention, the receptacle may also be formed of plastic. Thus, one element of the seal means is formed on the lid, while the other element is formed directly on the upper edge of the receptacle. In addition, mating elements of a snap-in connection may be formed on the receptacle and on the hinge block, for securing the hinge block to the receptacle. Alternatively, the hinge block may be glued in place.

In another embodiment of the invention, an adapter member is provided for securing the lid to a pre-existing vessel, such as a conventional bucket or pail, which is not necessarily constructed from plastic. The adapter member comprises a body having an upper longitudinal edge and a lower longitudinal edge. One element of the seal means is provided on the lid, while the mating element is provided on the upper longitudinal edge of the adapter member. Fastening means are provided for securing the lower longitudinal edge of the adapter body to the upper edge of the receptacle. The fastening means may take the form of a groove for receiving the upper edge of the receptacle. A seal is preferably placed in the groove to ensure that the vessel is airtight.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which:

FIG. 12 is a view generally corresponding to the illustration of FIG. 3, with the lid and hasp removed, and showing an alternate arrangement for supporting the hasp;

FIG. 13 is a view generally corresponding to the illustration of FIG. 4, and showing a sectional view through the alternate hasp support of FIG. 12, with the lid and hasp added;

FIG. 14 is a fragmentary sectional view of the lid, showing an alternate embodiment of the locking finger;

FIG. 15 is a view generally corresponding to FIG. 4, and showing still another alternate embodiment thereof;

DETAILED DESCRIPTION OF THE PREFERRED EMBODIMENTS

Figure 1:
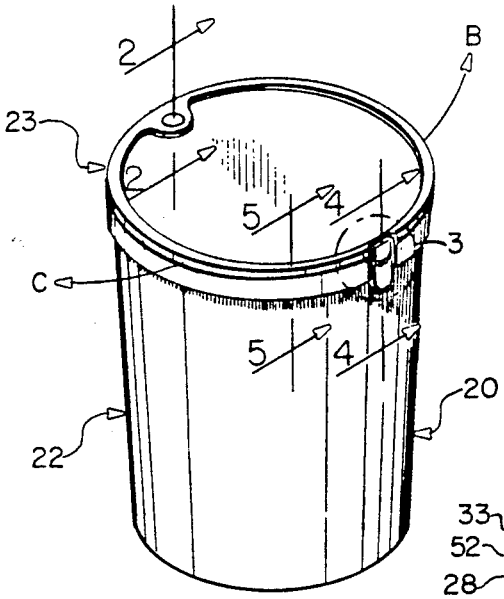
FIG. 1 is a perspective view of a container including a receptacle and a closure apparatus constructed in accordance with the teachings of the instant invention.
Figure 2:
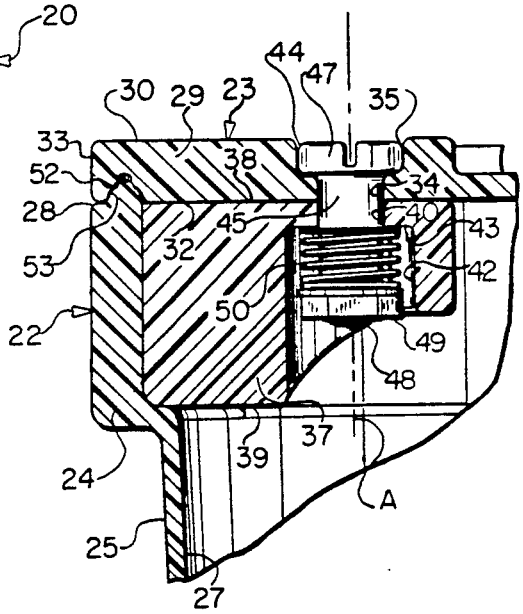
FIG. 2 is an enlarged fragmentary elevational view taken along the line 2—2 of FIG. 1.

Turning now to the drawings in which like reference characters indicate corresponding elements throughout the several views, attention is first directed to FIG. 1 which illustrates a container generally designated by the reference character 20 including a receptacle and a closure apparatus, generally designated by the reference characters 22 and 23, respectively. Receptacle 22, as seen with further reference to FIG. 2, includes an upstanding continuous side wall 24 having outer surface 25 and inner surface 27. At the upper end, side wall 24 terminates with edge 28 which circumscribes and defines an open end in receptacle 22. Although not specifically illustrated, but as will be readily appreciated by those skilled in the art, receptacle 22 further includes a bottom or closed end at a location spaced from upper edge 28.

Closure apparatus 23, in accordance with the immediately preferred embodiment thereof, includes generally rigid panel-like lid 29 having top surface 30, bottom surface 32 and peripheral edge 33. Lid 30 is sized to span the open end of receptacle 22 and rest upon the upper edge 28 of side wall 24. Preferably, peripheral edge 33 is congruent with outer surface 25. At a location near peripheral edge 33, bore 34 extends through lid 29. Counterbore 35, concentric with bore 34, extends inwardly from the top surface 30.

Hinge block 37 having top surface 38 and bottom surface 39 is glued or otherwise affixed to side wall 24 and extends inwardly therefrom. Bore 40 extends through hinge block 37. Counterbore 42 extends into hinge block 37 from bottom surface 39 concentric with bore 40 and forming shoulder 43 therebetween.

Pintle 44 extends through lid 29 and hinge block 37. More specifically, pintle 44 includes shank 45 rotatably journaled within bores 34 and 40. Head 47, carried at one end of shank 45, resides within counterbore 35. At the other end, shank 45 terminates with threaded portion 48 residing within counterbore 42. Nut 49 is threadingly engaged with the threaded portion 48. Compression spring 50 encircles shank 45 and is held in compression between nut 49 and shoulder 43.

Bores 34 and 40 and pintle 44 are coaxial along the axis represented by the broken line A. Accordingly, lid 29 is pivotally moveable relative receptacle 22 in either direction indicated by the arcuate arrowed lines B and C. In the closed position illustrated continuous bead 52, projecting upwardly from edge 28 of side wall 24, is matingly received within groove 53 formed in the undersurface 32 of lid 29. Further description of bead 52 and groove 53 will be made presently.

Figure 4:
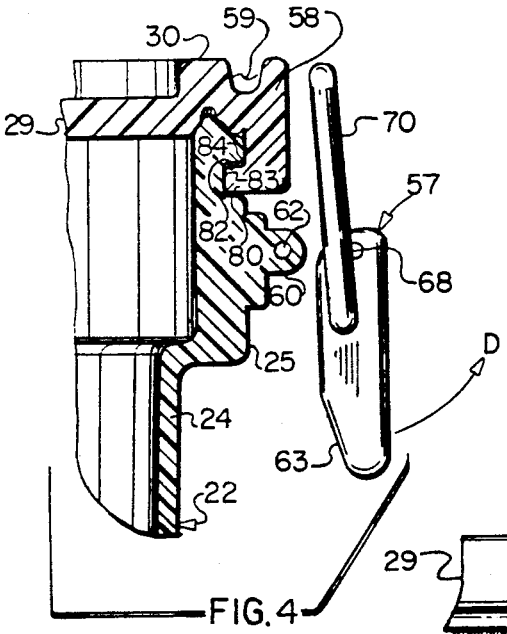
FIG. 4 is an enlarged fragmentary vertical sectional view taken along the line 4—4 of FIG. 1, parts thereof being exploded for purposes of illustration.
Figure 3:
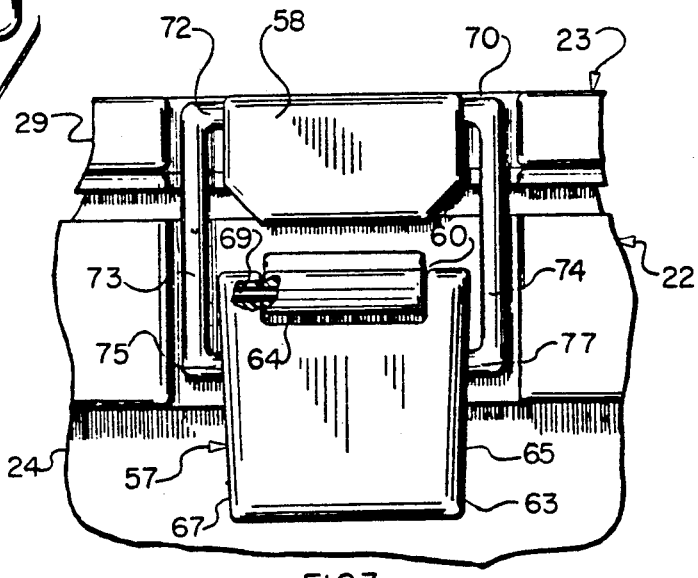
FIG. 3 is an enlarged fragmentary elevational view taken from within the area designated by the broken line circle 3 in FIG. 1, a portion thereof being broken away for purposes of illustration.

Closure structure 23 further includes a hasp for retaining lid 29 in the closed position. Reference is now made to FIGS. 3 and 4 which illustrate a preferred hasp, generally designated by the reference character 57 including a tab 58 projecting outwardly from lid 29 and having recess 59 formed in the upper surface thereof. Lug 60 having bore 62 therethrough projects outwardly from sidewall 24 of receptacle 22 at a location spaced below tab 58. Preferably, bore 62 extends along an axis which is substantially perpendicular to the axis A which is the axis of rotation of lid 29.

Hasp 57 further includes flap 63 having recess 64 therein which receives lug 60. Flap 63 further includes a pair of spaced apart longitudinal edges 63 and 67 and a transverse bore 68 extending therebetween within the area of recess 64. Pin 69 extends through the bores 62 and 68 to pivotally couple flap 63 to receptacle 22, for movement between a secured position as shown and a release position in the direction of arrowed line D. Latching element 70 interacts between tab 58 and flap 63 to retain lid 29 in a closed position. An inverted generally u-shaped member, latching element 70 includes transverse leg 72 extending between depending legs 73 and 74 which terminate with inwardly directed terminal portions 75 and 77, respectively, which pivotally engage flap 63 from the respective sides 67 and 65. Transverse leg 72 is sized to be received within recess 59.

The function of hasp 57 is analogous to that of an over-the-center toggle as will be readily understood by those skilled in the art. In the secured position, latching element 70 is under tension. Since the pivotal securement between flap 63 and lug 60 is outboard of the pivotal securement between latching element 70 and flap 63, flap 63 is held inwardly against sidewall 24 in the secured position. When flap 63 is pivotally moved in the direction of arrowed line D, latching element 70 is released from recess 59 to be swung outwardly from tab 58 whereby lid 29 is free to be moved.

An alternate arrangement for supporting pin 69 is illustrated in FIGS. 12 and 13. In this arrangement, lug 60 is replaced by a structure consisting of shelf 160 formed between a pair of spaced apart teeth 162. Each tooth 162 terminates in a downwardly curving hook 164. The shelf 160 extends beneath the central portion of pin 69, restraining it from any downward or inward motion, while the hooks 164 extend over the end portion of pin 69, restraining it from any upward or outward motion. This structure can easily be molded directly as an integral part of receptacle 22, without any need for boring or attachment of separate parts.

Returning now to FIG. 4, hasp 57 is especially devised for securely retaining lid 29 in the closed position during harsh handling such as transportation. For temporarily retaining lid 29 in the closed position and for providing convenient access to the container, closure apparatus 23 is preferably provided with a clasp including inwardly directed finger 80 having surface 82 and carried by tab 58. Also provided is recess 83 in outer surface 25 of sidewall 24 and having surface 84. When finger 80 is received within recess 83 surface 84 opposes surface 82 to hold lid 29 downwardly with bead 52 engaged within groove 53. Frictional engagement between the surfaces retards rotational movement of lid 29 relative receptacle 22

Referring back to FIG. 12, recess 83 preferably includes a sloped surface 85 which extends upwardly outwardly from either side of surface 84 to .function as a ramp for engaging surface 82 for camming finger 80 downwardly to ensure snug engagement of lid 29 in the closed position.

FIG. 1 shows another embodiment of lid 23 in which integrally formed finger 80 is replaced by an independent pin 176 which is press-fit in a bore 178 through tab 58. The distal end of pin 176 is received in recess 83 in generally the same manner as finger 80.

Figure 5:
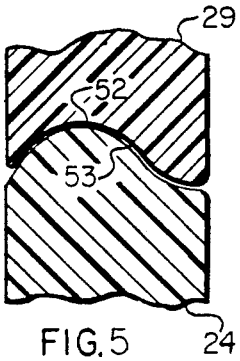
FIG. 5 is an enlarged fragmentary vertical sectional view taken along the line 5—5 of FIG. 1, the elements thereof being shown in the closed position.

The mating engagement between groove 53 and bead 52 is clearly seen in FIG. 5. Bead 52 and groove 53, which are held in mating engagement in response to the biasing of compression spring 50, function to retain lid 29 in alignment with the edge 28 of sidewall 25 during the closed position. The engagement also functions as a seal to retard thermal transfer through what would otherwise be a line-of-sight contact area between undersurface 32 of lid 29 and edge 28 of sidewall 24.

Figure 6:
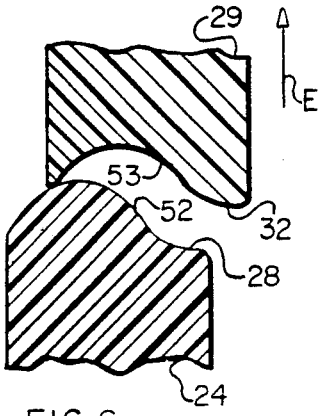
FIG. 6 is a view generally corresponding to the illustration of FIG. 7 and illustrating the elements thereof as they would appear during initial movement toward the open position.

As further seen in FIG. 6, bead 52 also functions as a cam for a cam follower which is defined as the apex between groove 53 and surface 32. It is apparent that two such apexes or cam followers are defined, one on either side of groove 53. In response to movement of lid 29 in either direction B or C, the appropriate cam follower rides upwardly upon bead 52 to raise lid 29 as indicated by the arrowed line E. Concurrently, in response to movement in either direction B or C, surface 82 of finger 80 is disengaged from surface 84 of recess 83. The movement of lid 29 is easily accomplished in response to appropriate manual pressure.

An alternate bead and groove construction is shown in FIG. 13. In this embodiment, bead 166 is generally triangular in cross-section, rather than bell-shaped as in FIGS. 5 and 6. That is, bead 166 includes a pair of sidewalls 168 of substantially constant slope, which converge at a slightly rounded apex 170. Groove 172 includes a pair of complementary sidewalls 174 having a slope equal to the slope of bead sidewalls 168. This enables bead 166 to stay in sealing engagement with groove 172 even if variations in the diameter of lid 23 or receptacle 22 were to cause lid 23 to ride higher on bead 166 than expected. The structure of lid 23 has also been altered to maintain a constant wall thickness of approximately 90 mil. or throughout the lid, thus increasing cycle times and molding efficiencies.

Figure 8:
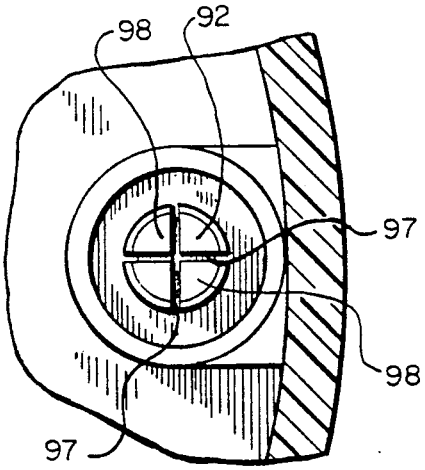
FIG. 8 is a horizontal sectional view taken along the line 88 of FIG. 7.
Figure 7:
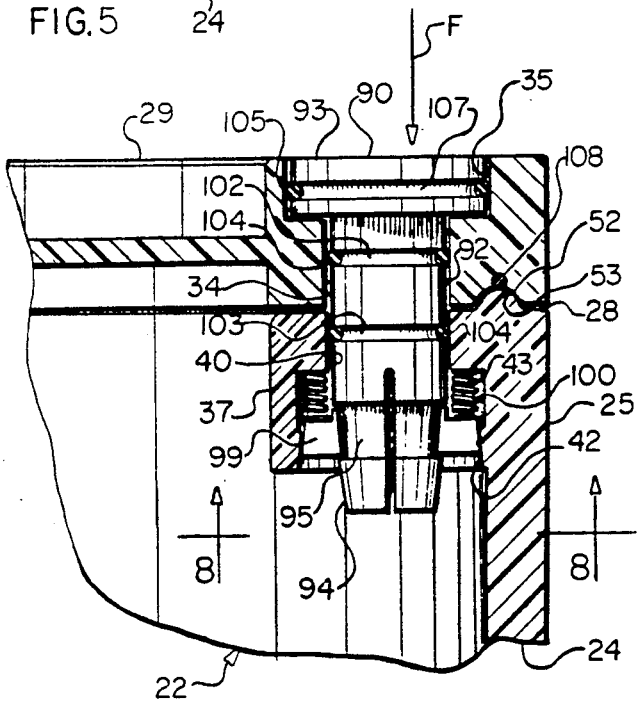
FIG. 7 is a view generally corresponding to the view of FIG. 2 and showing an alternate embodiment thereof.

An alternate pintle 90 for pivotally securing lid 29 to receptacle 22 is illustrated in FIG. 7. In accordance with the immediately preferred embodiment thereof, pintle 90 includes shank 92 which is rotatably journaled within bores 34 and 40. Head 93, carried at one end of shank 92, is received within counterbore 35. At the other end, shank 92 terminates with frustroconically tapered portion 94 and angular groove 95 which is spaced from the end. A pair of angularly disposed slits 97, as seen with further reference to FIG. 8, extend inwardly from the end of shank 92 to divide at least frustroconical portion 94 and groove 95 into a plurality of fingers 98. Collar 99 is retained upon shank 92 by groove 95. It will be appreciated by those skilled in the art, fingers 98 deflect inwardly for the passage of collar 99 to be received in snap engagement within groove 95. Compression spring 100 encircling shank 92 bears against shoulder 43 and collar 99 to urge downward pressure upon pintle 90 and subsequently lid 29.

First and second angular grooves 102 and 103, respectively, are formed in shank 92. A toroidal seal 104, preferably a conventional commercially available O-ring, resides in each of the angular grooves 102 and 103. Groove 102 resides in the area of bore 34 while groove 103 resides in the area of bore 40. Hence, shank 92 is sealingly engaged with the bores 34 and 40. Similarly, head 93 is sealingly engaged with counterbore 35 by virtue of toroidal seal 105 residing within angular groove 107.

Complementing the seals carried by the pintle, the immediate embodiment of the closure apparatus further includes an ameliorated seal between groove 53 and bead 52. Preferably, in accordance with the immediately preferred embodiment of the invention, an annular seal 108, which may be in the form of a conventional O-ring is carried within an appropriately sized and shaped groove 52. Seal 108 sealingly engages bead 53 when lid 29 is in the closed position.

Figure 18:
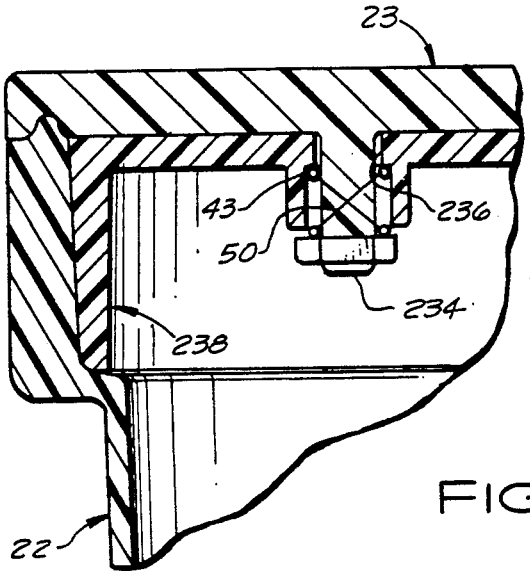
FIG. 18 is a view generally corresponding to FIG. 2, and showing still another alternate embodiment thereof.

Still another pintle 234 is illustrated in FIG. 18. Pintle 234, according to the instant embodiment, comprises an integrally formed projection depending from the lower surface of lid 23 and extending through bore 236 in hinge block 248. In general similarity to the embodiment of FIG. 2, a compression spring 50 encircles pintle 234 and is held in compression between nut 49 and shoulder 43. The instant embodiment may be preferred when lid 23, receptacle 22, and hinge block 238 are all formed from plastic, since it reduces the overall number of parts. In addition, sealing is improved, since bore 34 and counterbore 35 in lid 23 are eliminated. Conversely, the arrangement of FIG. 2 may be preferable in combination with a metal receptacle, since pintle 44 can also be made of metal, resulting in a stronger attachment between receptacle 22 and lid 23.

Figure 9:
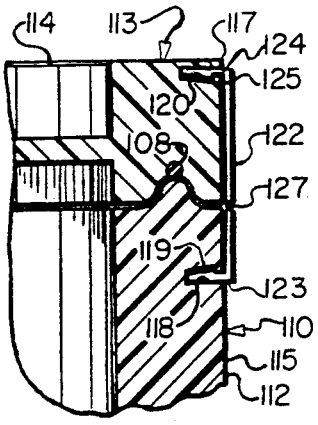
FIG. 9 is a view generally corresponding to illustration of FIG. 4 and showing another alternate embodiment thereof.

FIG. 9 illustrates a alternate embodiment of the invention including receptacle 110 having sidewall 112 and closure apparatus 113 including lid 114. Sidewall 112 includes outer surface 115 while lid 114 includes peripheral edge 117. For details not specifically illustrated and described, reference is made to the detailed description of the prior embodiments.

In accordance with the immediately preferred embodiment, an annular groove 118 is formed into sidewall 112 from the outer surface 115 thereof. Groove 118 includes an inwardly directed circumferential shoulder 119 which opposes surface 115. A mirror image groove 120 is carried by lid 114 in parallel-spaced relationship to groove 118. Cylindrical band 122, encircling the container, terminates with inwardly projecting flanges 123 and 124, respectively, which are received within the grooves 118 and 120, respectively. Each flange 123 and 124 includes an outwardly directed shoulder 125 which engages the respective shoulder 129 to retain the band 122 in engagement with the sidewall 112 and the lid 114. Accordingly, the closure apparatus is securely held in the closed position to prevent accidental opening where it is anticipated that the container will be subjected to exceptionally rough handling, such as during long distance transportation, or to ensure the integrity of the contents. Impression 127 formed in band 122, preferably in alignment with the juncture between the top edge of sidewall 122 and the bottom edge of lid 114, facilitates opening. It is anticipated that a deliberate action, such as cutting with a knife, is required to sever the band 122.

FIG. 15 shows an alternate locking band 180, which is formed integrally with lid 123 but otherwise performs essentially the same function as band 122 in FIG. 9. The inner surface of locking band 180 includes a groove 182 which mates with a flange 184 extending radially outwardly from receptacle 22 to securely lock lid 23 thereto. A notch 186 extends continuously along the intersection between lid 23 and band 180, thus forming a weakened portion which allows band to be easily severed from lid 23 in response to downward pressure from a utility knife.

Figure 10:
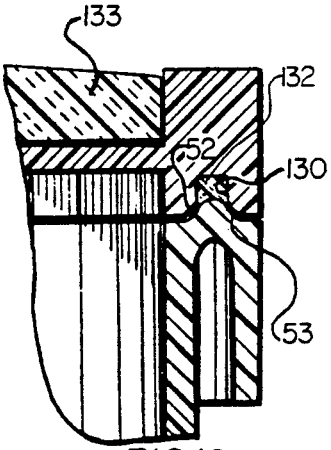
FIG. 10 is a view generally corresponding to the illustration of FIG. 4 and showing yet another alternate embodiment thereof.

Greater sealing between the lid and the edge of the receptacle is achieved in accordance with the embodiment illustrated in FIG. 10. A generally rectangular seal groove 130 is formed into groove 53 at a generally central location to carry annular seal 132. The seal 132 receives a substantial portion of bead 135 over a greater surface area than the previously described seal 108. The immediate embodiment is further enhanced by insulating material 133, such as foamed plastic, which fills the recess within the lid.

Figure 16:
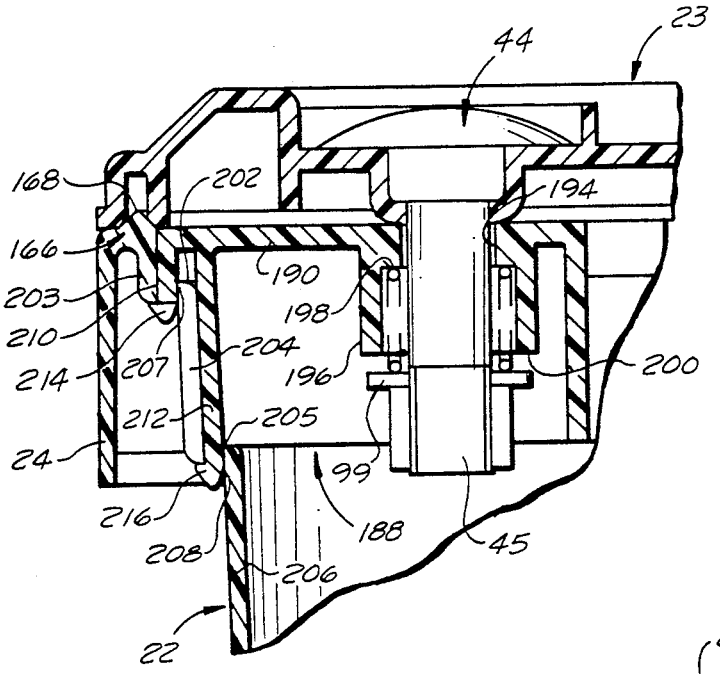
FIG. 16 is a view generally corresponding to FIG. 2, and showing another alternate embodiment thereof.

An alternate hinge block 188 is illustrated in FIG. 16. For greater ease in molding, the solid structure of hinge block 37 is replaced with a thin-walled structure consisting of top surface 190 defining a bore 194 for receiving the shank 45 of pintle 44. An annular inner wall 196 depends from shoulder 198. The bottom edge 200 of inner wall 196 defines a stop surface which limits the upward movement of collar 99 carried by shank 45. This restricts the vertical travel of lid 23 so that it only migrates upward enough to clear the apex 168 of sealing bead 166. As a result, downward movement of the lid when open is also limited, resulting in greater stability when items are placed thereon.

Also illustrated in FIG. 16 is a snap-in arrangement for securing hinge block 188 to receptacle 22. In this arrangement, the upper edge of sidewall 24 is molded in a stepped configuration including an upper shelf 202, bounded by resilient sidewall sections 203 and 204, and a lower shelf 205, bounded by resilient sidewall sections 204 and 206. A first slot 207 is formed in upper shelf 202, and a second slot 208 is formed in lower shelf 205. Hinge block 188 is provided with a pair of depending legs, including a shorter leg 210 for insertion through first slot 207 and a longer leg 212 for insertion through second slot 208. Each of the legs 210, 212 is equal in thickness to the corresponding slot 207, 208, except for a thickened portion or nub 214 formed at the lower end of leg shorter leg 210, and a similar nub 216 formed at the lower end of longer leg 212. Nubs 214, 216 are tapered in such a way as to force resilient sidewalls 203, 204 and 206 apart, allowing legs 210 and 212 to travel downwardly in the slots 207, 208. However, once the legs 210, 212 have been fully inserted, sidewalls 203, 204 and 206 snap back into place, and the upper surface of the nubs 214, 216 abut the corresponding lower surface walls 203 and 204, respectively, so that legs 210, 212 can not be pulled back out. Accordingly, hinge block 188 is restrained from both lateral and vertical movement.

Figure 17:
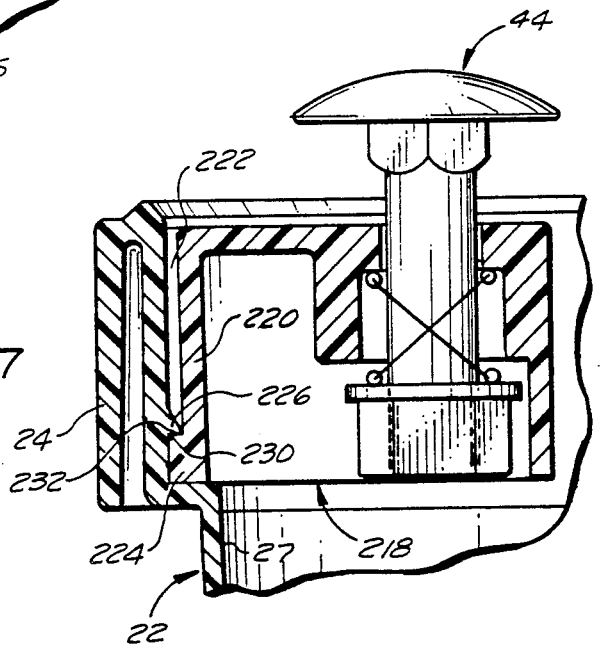
FIG. 17 is a view generally corresponding to FIG. 2, and showing yet another alternate embodiment thereof.

Another snap-in arrangement for securing the hinge block to the receptacle 22 is illustrated in FIG. 17. The hinge block 218 according to this embodiment is generally bell-shaped when viewed from the top (not illustrated), where the flared portion of the bell defines a resilient outer wall 220 contacting inner surface 27 of sidewall 28, and functions as a dovetail for insertion into a mating socket 222 in sidewall 28. The lower portion of outer wall 220 includes an outwardly projecting nub 224 which is opposed by a tapered, inwardly projecting nub 226 on the inner surface of sidewall 28.

When hinge block 218 is forced downwardly in socket 222, tapered nub 226 exerts an inward lateral pressure on nub 224, causing wall 220 to flex and allowing nub 224 to pass nub 226. Once nub 224 passes nub 226, outer wall 220 of hinge block 218 snaps back into place so that upper surface 230 of nub 226 abuts lower surface 232 of nub 228, preventing upward movement of hinge block 220. Circumferential and radial movement of the hinge block is similarly prevented by the engagement between the dovetail ends of wall 220 and the corresponding end walls (not shown) of slot 222.

Figure 11:
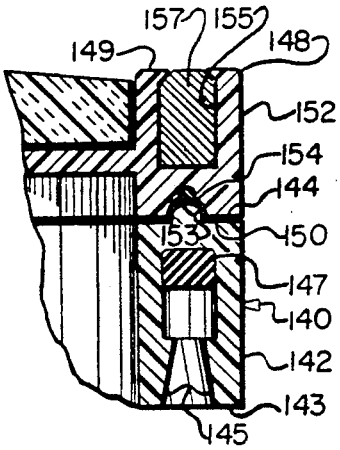
FIG. 11 is a view generally corresponding to the illustration of FIG. 5 and showing still another alternate embodiment thereof.

Finally, FIG. 11 illustrates yet another closure apparatus embodying the principles of the instant invention and generally designated by the reference character 140. Especially adapted to be detachably secured to a selected pre-existing vessel, such as a convention bucket or pail, the immediate embodiment includes body 142 having lower edge 143 and upper edge 144. Groove 145 formed into body 142 from lower edge 143 receives the upper portion of the sidewall of the selected vessel. Seal 147 receives the upper edge of the side wall for sealing engagement between the vessel and body 142. Body 142, which is continuous, is sized and shaped as appropriate to receive the vessel. Further, body 142 may be secured to the vessel by various means. Exemplary is friction fit within the groove 145 or the use of conventional bonding agents.

Closure apparatus 140 further includes lid 148 which in general similarity to the previously described embodiments, includes top surface 149 undersurface 150 and a peripheral edge 152. Lid 148 further includes continuous groove 153 formed into under surface 150 which matingly receives bead 154 upstanding from edge 144 of body 142. In all other aspects, including the pivotal securement to body 142, lid 149 is structurally and functionally analogous to the previously described embodiments.

Further in accordance with the immediate embodiment of closure apparatus 140, a generally cylindrical groove 155 is formed into lid 148 from the top surface 149 at a location near peripheral edge 152. Reinforcing member 157 is carried within groove 155. Closure apparatus 140, in general similarity to the previously described embodiments, is preferably fabricated of a plastic material especially chosen to have insulating properties. For purposes of adding rigidity to the lid, reinforcing member 157 is preferably fabricated of metal. It is understood that such a reinforcing member may be used in combination with the previously described embodiments of the invention.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

I claim:

1. A method of manufacturing a container, comprising the steps of:

a) providing a receptacle including an upstanding sidewall having an upper edge defining an open end;

b) forming a lid from plastic;

c) pivotally affixing said lid to said receptacle for rotational movement from a closed position to an open position;

d) forming an element of a male/female engagement pair continuously along the upper edge of said sidewall;

e) forming a complemental element of said male/-female engagement pair on said lid for mating with said element to create a seal;

f) providing biasing means for retaining said element in engagement with said complemental element when said lid is in said closed position; and g) providing cam means opposing said biasing means for disengaging said element from said complemental element.

2. A method according to claim 1, wherein said step of pivotally affixing said lid to said receptacle includes the substeps of:

a) securing a hinge block defining a bore to the sidewall of said receptacle;

b) providing said lid with a depending pintle; and c) inserting and retaining said pintle in said bore.

3. A method according to claim 2, wherein said substep of securing said hinge block to said sidewall comprises the sub-substeps of:

a) forming a first element of a snap attachment on said hinge block;

b) forming a second element of said snap attachment on said sidewall; and c) pressing said first element into engagement with said second element.

4. A method according to claim 2, wherein said substep of securing s id hinge block to said sidewall includes the substeps of:

a) securing an adapter body to the upper edge of said sidewall; and b) securing said hinge block to said adapter body.

5. A method according to claim 1, further comprising the steps of:

a) forming a projection on one of said lid and said receptacle; and b) forming a recess in the other of said lid and said receptacle for receiving said projection to temporarily retain said lid in said closed position.

6. A method according to claim 5, further comprising the step of providing auxiliary locking means for acting with said projection and said recess to maintain said lid in said closed position during rough handling.

* * * * *